United States Patent [19]

Branscheid et al.

[11] 4,304,024

[45] Dec. 8, 1981

[54] DE-ICING DEVICE

[76] Inventors: Hans-Eginhard Branscheid, Grüne Weg, D 588 Lüdenscheid; Peter Bretschneider, Parhsharte 104, D-588 Lüdenscheid; Rolf Geyer, Buschhauser Weg 156, D 5880 Lüdenscheid; Volker Schröer, Mühlhagenar Weg 12, D 5880 Ludenscheid, all of Fed. Rep. of Germany

[21] Appl. No.: 153,647

[22] Filed: May 27, 1980

[30] Foreign Application Priority Data

Nov. 12, 1979 [DE] Fed. Rep. of Germany ..... 2945616

[51] Int. Cl.[3] ..... A47L 1/06; A47L 13/02

[52] U.S. Cl. ..... 15/105; 15/236 R

[58] Field of Search ..... 15/105, 236 R; 431/129, 431/130

[56] References Cited

U.S. PATENT DOCUMENTS

| | | | |
|---|---|---|---|
| 1,766,529 | 6/1930 | Peirson | 15/236 R |
| 2,981,964 | 5/1961 | Downing | 15/236 R X |
| 3,754,831 | 8/1973 | Hutter | 15/105 |
| 3,935,425 | 1/1976 | Weissberger | 15/236 R |

*Primary Examiner*—Edward J. McCarthy

*Attorney, Agent, or Firm*—Spencer & Kaye

[57] ABSTRACT

A de-icing device comprises a lighter and a flame tube inserted thereon and provided with aligned openings through which a key can be inserted for exposure to the heat of the lighter flame. The lighter and the flame tube are partially accommodated in housing; the parts of the lighter and the flame tube that project from the housing are covered by a removable top closure which, when in place, constitutes an entirely closed casing together with the housing. On the outside of the housing and the top closure there are formed matching length portions of a scraper edge for using the device as an ice scraper when the top closure is in place.

10 Claims, 9 Drawing Figures

Fig. 6c
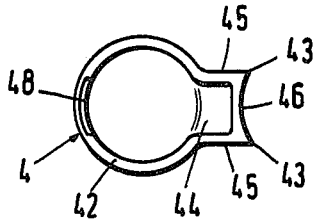
Fig. 6b
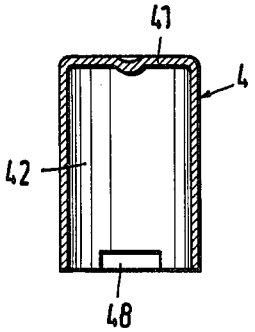
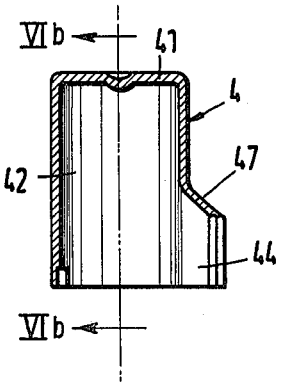
Fig. 6a
Fig. 5a
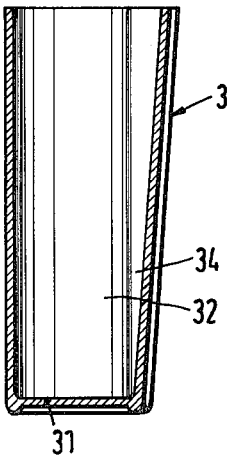
Fig. 5b
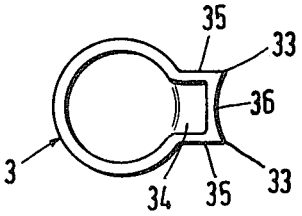

DE-ICING DEVICE

BACKGROUND OF THE INVENTION

This invention relates to devices for thawing out frozen locks or for removing ice from planar surfaces, such as window panes. Such devices are widely used in connection with atuomotive vehicles under cold temperature conditions.

It is known to defrost locks, particularly door locks of automotive vehicles, by heating the key of the lock in a device which comprises a lighter and a flame tube inserted thereon and wherein the flame tube has openings which are aligned transversely to the length dimension of the flame tube and through which the key may pass to be positioned above the flame. Thus, the key traversing the flame tube openings can be heated and thereafter removed from the flame tube and inserted into the lock for thawing and then opening the same.

It is further known to remove ice and frost from relatively small window panes, such as vehicle windows or windshields by means of flat plastic scrapers. These devices have a scraper edge and a handle at a side opposite the scraper edge. The device is positioned on the window pane such that the scraper edge lies flat thereon and then the device is guided along and pressed against the window by manipulating the handle.

The above-outlines known prior art devices are limited in their use, in that any one device is adapted to work only on locks or only on windows.

SUMMARY OF THE INVENTION

It is an object of the invention to provide an improved de-icing device which can be used both for thawing out locks and scraping ice from planar surfaces, particularly window panes, which is of handy, pocket size and which is assemblable in a simple manner from simple individual components and is of pleasing appearance.

This object and others to become apparent as the specification progresses, are accomplished by the invention, according to which, briefly stated, the de-icing device comprises a lighter and a flame tube inserted thereon and provided with aligned openings through which a key can be inserted for exposure to the heat of the lighter flame. The lighter and the flame tube are partially accommodated in a housing; the parts of the lighter and the flame tube that project from the housing are covered by a removable top closure which, when in place, constitutes an entirely closed casing together with the housing. On the outside of the housing and the top closure there are formed matching length portions of a scraper edge for using the device as an ice scraper when the top closure is in place.

BRIEF DESCRIPTION OF THE DRAWING

FIG. 5*a* is a longitudinal sectional view of another component of the preferred embodiment.

FIG. 5*b* is a bottom plan view of the structure shown in FIG. 5*a*.

FIG. 6*a* is a longitudinal sectional view of still another component of the preferred embodiment.

FIG. 6*b* is a sectional view taken along line VI*b*—VI*b* of FIG. 6*a*.

FIG. 6*c* is a top plan view of the structure illustrated in FIGS. 6*a* and 6*b*.

DESCRIPTION OF THE PREFERRED EMBODIMENT

Figure 1:
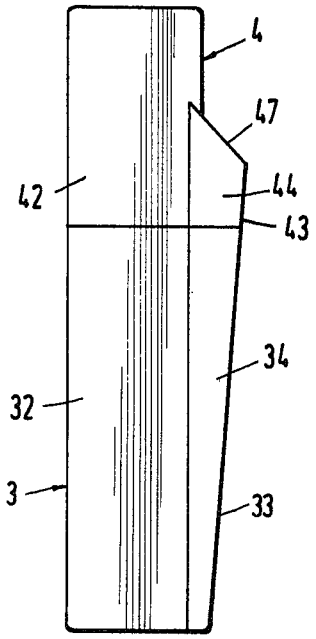
FIGS. 1 and 2 are elevational views of a preferred embodiment of the invention with the top closure in place and with the top closure removed, respectively.
Figure 3:
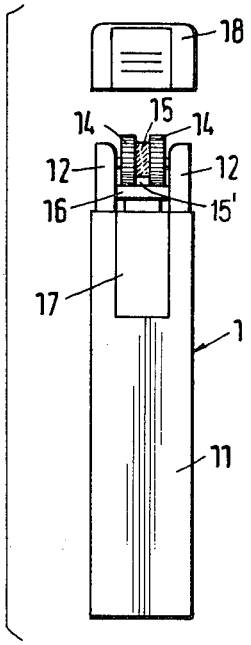
FIG. 3 is an exploded elevational view of a component of the preferred embodiment.
Figure 2:
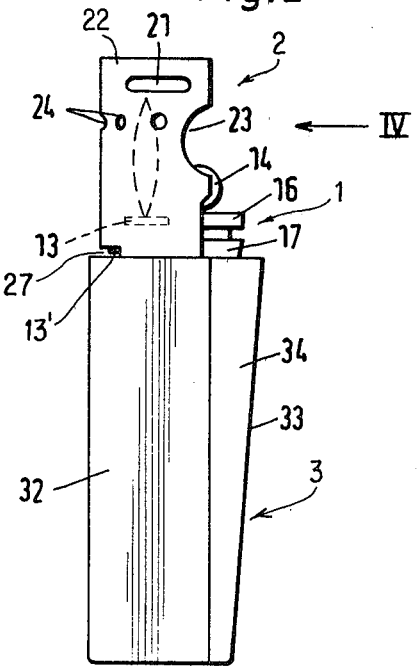

Turning now to FIGS. 1, 2 and 3, the de-icing device illustrated therein and constituting a preferred embodiment of the invention includes a lighter 1 on which there is inserted a flame tube 2. Both components 1 and 2 are partially received in a housing 3. The parts of the lighter 1 and the flame tube 2 which project beyond the housing 3 may be covered by a removable top closure 4. As seen in FIG. 1, the housing 3 and the top closure 4 constitute a continuous casing.

Particularly referring to FIGS. 2 and 3, the lighter 1 in essence comprises a cylindrical jacket 11, most of which serves as a fuel reservoir. A burner 13 is disposed at an extended end portion of the jacket 11, between two lateral walls 12 thereof. The lateral walls 12 further support a rotary spark generator formed of two coaxially arranged, manually engageable knurled wheels 14 and a friction wheel 15 which is affixed to the knurled wheels 14 and which engages a flint 15' pressed against the friction wheel 15 in a conventional manner.

Underneath the wheel assembly 14, 15 there is arranged a control lever 16 by means of which fuel gas can be supplied to or cut off from the burner 13 and which is pivotally supported by the side walls 12. The control lever 16 is situated above a platform 17 which projects wedge-like from the jacket 11 and extends approximately to the height level of the burner 13. The entire burner mechanism is covered by a shroud 18 inserted on the jacket 11 over the side walls 12. The shroud 18 which is shown separated from the jacket 11 and is not illustrated in FIG. 2, has appropriate openings for maintaining a free access to actuate the wheels 14 and the control lever 16 as well as to allow passage of the flame emitted by the burner 13.

Figure 4:
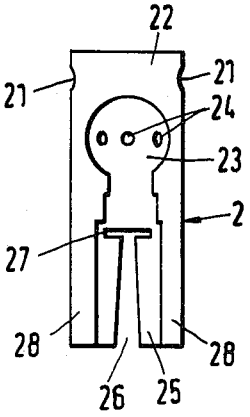
FIG. 4 is an elevational view of another component of the preferred embodiment, as seen in the direction of arrow IV in FIG. 2.

Turning now to FIGS. 2 and 4, the flame tube 2 has a closed, circular top 22, in the vicinity of which the tube wall has diametrically oppositely arranged, slot-like, aligned openings 21 through which an article to be heated, such as a key for a lock, may be introduced for exposure to the flame within the flame tube 2. The wall of the flame tube 2 further has an oval (arcuate) opening 23 which permits access to the knurled wheels 14 as may be best observed in FIG. 2. At the height level of the oval opening 23 the flame tube 2 is provided with a plurality of circumferentially arranged air inlet openings 24. The flame tube 2 further has a relatively wide and long slot 25 which extends from that end of the flame tube 2 which is opposite the circular top 22 and which merges into the oval opening 23. Diametrically opposite the slot 25, the flame tube 2 has a relatively narrow and short slot 26 which extends from the same end of the flame tube 2 as the slot 25 and which terminates in a transverse slot 27. Through the transverse slot 27 an actuating component 13' for adjusting the flame height is accessible. Flame tube legs 28 defined by the slots 25 and 26 give resiliency to the lower portion of the flame tube 2, so that the latter may be inserted into the housing 3 under spring effect and further, when in place as shown in FIG. 2, the flame tube 2 resiliently clamps around the lighter jacket 11.

Turning now to FIGS. 5*a*, 5*b*, 6*a*, 6*b* and 6*c*, the housing 3 and the top closure 4 are both of hollow cylindrical configuration closed by a base at one end and open at the opposite end. Thus, the housing 3 has a cylindrical body 32 terminating in a bottom 31 (FIG. 5*a*), while the top closure 4 has a cylindrical body 42 terminating in a top wall 41 (FIG. 6*a*).

Turning in particular to FIGS. 5*a* and 5*b*, the housing 3 comprises, along the cylinder body 32, a radially projecting, inwardly hollow rib 34 formed of side walls 35 and having, at its exterior, a concave, trough-like groove 36 bounded along both sides by longitudinally extending de-icing (scraper) edges 33. The hollow rib 34 of the housing 3 accommodates, at its upper portion, the platform 17 of the lighter 1, as may be observed in FIG. 2. This arrangement ensures that the housing 3 is prevented from rotating with respect to the lighter 1.

Reverting now particularly to FIGS. 6*a*, 6*b* and 6*c*, the top closure 4, similarly to the housing 3, comprises an inwardly hollow rib 44 formed of side walls 45 and having, at its exterior, a concave, trough-like groove 46 bounded by de-icing (scraper) edges 43. When the top closure 4 is in place as shown in FIG. 1, the rib structure 44 constitutes a continuation of the rib structure 34 of the housing 3. Further, when the top closure 4 is in place, the hollow rib 44 accommodates the control lever 16 of the burner mechanism.

Thus, the de-icing (scraping) edges 33, 43 are defined by the parallel-extending lateral walls 35 and 45 on the one hand and by the outer concave walls 36, 46 on the other hand.

The rib 34 starts at the bottom 31 of the housing 3 and continues, as rib 44, beyond the parting line between the housing 3 and the top closure 4. Starting from the bottom 31, the rib 34 slightly diverges outwardly from the axis of the cylindrical body 32. Beyond the parting line between the housing 3 and the top closure 4, the rib structure thus continues linearly in an uninterrupted manner approximately to a length which is one third the length of the top closure 4. Then the rib slopes, with an oblique part 47, towards the body 42 of the top closure 4 and merges thereinto.

Referring particularly to FIGS. 6*b* and 6*c*, the top closure 4 has an arcuate groove 48 along a circumferential portion of its bottom edge and diametrically opposite the rib 44. The groove 48 receives the free end portion of the flame adjuster 13' that projects beyond the slot 27 provided in the flame tube 2.

Thus, the invention provides a combined unitary de-icing device whose lighter portion is structured to heat for example, a key in order to thaw out a lock and which, preferably in its closed position by virtue of its particularly structured housing 3 and top closure 4, serves as a scraper for de-icing surfaces, such as window panes. The versatile device according to the invention does not appreciably exceed the dimensions of known lighter devices and is therefore of handy, pocket size and is furthermore of pleasing appearance.

It will be understood that the above description of the present invention is susceptible to various modifications, changes and adaptations, and the same are intended to be comprehended within the meaning and range of equivalents of the appended claims.

What is claimed is:

1. A de-icing device including a lighter having a burner, a flame tube attached to the lighter about the burner; said flame tube having apertures through which an article to be heated may be passed for positioning over the burner; the improvement comprising a housing having a length dimension, an interior and an outer face; said housing receiving first length portions of said lighter and said flame tube in said interior; remaining second length portions of said lighter and said flame tube projecting out of said housing in said length dimension thereof; said housing further including rib means on said outer face along said length dimension; said rib means defining a scraper edge extending in the length dimension of said housing.

2. A de-icing device as defined in claim 1, wherein said lighter includes manually engageable spark generating means and flame adjusting means, and further wherein said flame tube has a closed annular end portion in the zone of said apertures, an open end remote from said closed annular end portion, an arcuate opening for providing manual access to said spark generating means; vent openings in the zone of said arcuate opening, a relatively wide slot extending from said open end and merging into said arcuate opening and a relatively narrow slot extending from said open end diametrically opposite said relatively wide slot, said relatively narrow slot terminating in a transverse slot receiving portions of said flame adjusting means in the inserted position of said top closure; said relatively wide and relatively narrow slots dividing a length portion of said flame tube into resilient leg portions for surrounding said lighter with a resilient clamping force.

3. A de-icing device as defined in claim 1, further comprising rotation-preventing means connecting said housing to said lighter for preventing a turning motion of said housing relative to said lighter about an axis extending parallel to said length dimension.

4. A de-icing device as defined in claim 3, wherein said rib means is hollow as viewed from said interior of said housing; said rotation-preventing means is a platform forming part of said lighter and having a portion projecting into the hollow rib means.

5. A de-icing device as defined in claim 1, further comprising a top closure having a length dimension, an interior and an outer face and being removably insertable over said remaining second length portions of said lighter and said flame tube; said top closure further including rib means on said outer face of said top closure along said length dimension thereof; said rib means of said top closure defining a scraper edge extending in the length dimension of said top closure; said scraper edge on said housing and said scraper edge on said top closure being uninterrupted continuations of one another in the inserted position of said top closure.

6. A de-icing device as defined in claim 5, wherein said lighter includes a manually actuatable flame control lever and further wherein said rib means of said top closure is hollow as viewed from said interior of said top closure; said flame control lever having a portion projecting into the hollow rib means of said top closure in the inserted position of said top closure.

7. A de-icing device as defined in claim 5, further wherein said lighter includes flame adjusting means; further wherein said top closure includes means defining an arcuate groove in the interior of said top closure diametrically opposite said rib means of said top closure; said arcuate groove receiving portions of said flame adjusting means in the inserted position of said top closure.

8. A de-icing device as defined in claim 5, wherein said housing is essentially formed of a first cylindrical body closed at one end by a bottom and open at an opposite end; further wherein said rib means of said housing is hollow as viewed from the interior of said housing and is formed on said first cylindrical body; said rib means on said first cylindrical body extending from said bottom to an opposite end of said first cylindrical body; said scraper edge being divergent from a longitudinal axis of said first cylindrical body as viewed in a direction oriented away from said bottom; further wherein said top closure is essentially formed of a second cylindrical body closed at one end by a top wall and open at an opposite end; further wherein said rib means of said top closure is hollow as viewed from the interior of said top closure and is formed on said second cylindrical body; said rib means on said second cylindrical body extending from the open end thereof; the scraper edge formed by said rib means on said top closure being divergent from a longitudinal axis of said second cylindrical body as viewed in a direction oriented towards said top wall of said top closure.

9. A de-icing device as defined in claim 8, further wherein said scraper edge formed by the rib means of said top closure terminates at a location spaced from the open end of said top closure at approximately one third of the length of said top closure; said rib means on said top closure further comprising an oblique portion extending from said location towards the longitudinal axis of said second cylindrical body and merging into said second cylindrical body.

10. A de-icing device as defined in claim 9, wherein each rib means is formed of two lateral walls interconnected by an outwardly concave wall; in each said rib means each lateral wall defines a scraper edge with said outwardly concave wall, whereby each rib means has two parallel spaced scraper edges.

* * * * *